US010976012B2

(12) United States Patent
Wang et al.

(10) Patent No.: US 10,976,012 B2
(45) Date of Patent: Apr. 13, 2021

(54) LIGHT SOURCE APPARATUS AND LIGHTING DEVICE

(71) Applicant: OPPLE LIGHTING CO., LTD., Shanghai (CN)

(72) Inventors: Guoping Wang, Shanghai (CN); Xuejun Feng, Shanghai (CN); Hongbo Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 8 days.

(21) Appl. No.: 16/413,544

(22) Filed: May 15, 2019

(65) Prior Publication Data

US 2019/0264880 A1 Aug. 29, 2019

Related U.S. Application Data

(63) Continuation of application No. PCT/CN2017/114596, filed on Dec. 5, 2017.

(30) Foreign Application Priority Data

Dec. 5, 2016 (CN) ..... 201621322923.X

(51) Int. Cl.
*F21S 2/00* (2016.01)
*F21S 4/20* (2016.01)
(Continued)

(52) U.S. Cl.
CPC ..... *F21S 2/005* (2013.01); *F21K 9/272* (2016.08); *F21K 9/278* (2016.08); *F21S 2/00* (2013.01);
(Continued)

(58) Field of Classification Search
CPC ..... F21S 2/005; F21S 2/00; F21S 4/20; F21K 9/272; F21K 9/275; F21K 9/278;
(Continued)

(56) References Cited

U.S. PATENT DOCUMENTS 5,702,176 A * 12/1997 Engle ..... F21S 2/00 362/219
7,331,687 B1 * 2/2008 Noh ..... F21S 2/00 362/217.05
(Continued)

FOREIGN PATENT DOCUMENTS

CN 203273622 U 11/2013
CN 204477970 U 7/2015
(Continued)

OTHER PUBLICATIONS

International Search Report and Written Opinion issued in PCT/CN2017/114596, dated Feb. 28, 2018, 10 pages.

*Primary Examiner* — Bryon T Gyllstrom
*Assistant Examiner* — James M Endo
(74) *Attorney, Agent, or Firm* — Arch & Lake LLP

(57) ABSTRACT

A light source apparatus and a lighting device are provided. The light source apparatus includes a light source assembly, a power source assembly, a first end cap, and a second end cap. The light source assembly includes a light source part and a light diffuser. An interior of the light diffuser includes a first receiving space which extends along a lengthwise direction of the light diffuser and penetrates the light diffuser. The light source part is mounted in the first receiving space along a lengthwise direction of the light diffuser. The power source assembly includes a power source part and a power source cover. An interior of the power source cover includes a second receiving space which extends along a lengthwise direction of the power source cover and penetrates the power source cover. The power source part is mounted in the second receiving space.

20 Claims, 6 Drawing Sheets

(51) Int. Cl.

| | |
|---|---|
| ***F21K 9/272*** | (2016.01) |
| ***F21K 9/278*** | (2016.01) |
| ***F21V 17/10*** | (2006.01) |
| ***F21V 21/14*** | (2006.01) |
| ***F21V 23/06*** | (2006.01) |
| ***F21V 21/00*** | (2006.01) |
| ***F21Y 115/10*** | (2016.01) |
| ***F21Y 103/00*** | (2016.01) |
| ***F21Y 113/00*** | (2016.01) |

(52) U.S. Cl.
CPC ..... *F21S 4/20* (2016.01); *F21V 17/10* (2013.01); *F21V 21/00* (2013.01); *F21V 21/14* (2013.01); *F21V 23/06* (2013.01); *F21Y 2103/00* (2013.01); *F21Y 2113/00* (2013.01); *F21Y 2115/10* (2016.08)

(58) Field of Classification Search
CPC ..... F21V 23/06; F21V 23/007; F21V 23/006; F21V 23/003; F21V 23/023; F21V 23/026; F21V 23/02; F21V 23/004; F21V 23/008; F21V 15/015; F21V 21/32; F21V 21/096; F21V 21/0965
See application file for complete search history.

(56) References Cited

U.S. PATENT DOCUMENTS

2007/0223218 A1* 9/2007 You ..... F21V 31/005 362/231
2008/0174992 A1* 7/2008 Lin ..... F21S 8/031 362/217.05
2009/0230896 A1* 9/2009 Lin ..... F21V 23/06 315/324
2010/0053965 A1* 3/2010 Chang ..... F21K 9/27 362/249.02
2010/0118564 A1* 5/2010 Shen ..... F21S 8/043 362/647
2010/0195322 A1* 8/2010 Kawakami ..... F21V 9/32 362/231
2010/0270925 A1* 10/2010 Withers ..... F21V 29/004 315/51
2010/0271804 A1* 10/2010 Levine ..... F21S 4/20 362/35
2011/0038147 A1* 2/2011 Lin ..... F21V 19/004 362/235
2011/0128723 A1* 6/2011 Coleman ..... F21V 21/30 362/183
2011/0156587 A1* 6/2011 Wu ..... F21V 29/80 315/35
2012/0314407 A1* 12/2012 Souvay ..... F21S 4/28 362/191
2013/0094224 A1* 4/2013 Miyatake ..... F21S 4/20 362/363
2013/0188344 A1* 7/2013 Dobler ..... B64D 47/02 362/223
2014/0009926 A1* 1/2014 Simon ..... F21V 17/12 362/222
2014/0036505 A1* 2/2014 Barton ..... F21S 2/00 362/249.06
2014/0111983 A1* 4/2014 Yang ..... F21V 23/005 362/222
2014/0160743 A1* 6/2014 Ye ..... F21K 9/69 362/223
2015/0176803 A1* 6/2015 Germain ..... F21S 8/06 362/217.05

FOREIGN PATENT DOCUMENTS

| | | | |
|---|---|---|---|
| CN | 204494166 | U | 7/2015 |
| CN | 105222057 | A | 1/2016 |
| CN | 105240809 | A | 1/2016 |
| CN | 206514116 | U | 9/2017 |
| JP | 2002367405 | A | 12/2002 |

* cited by examiner

LIGHT SOURCE APPARATUS AND LIGHTING DEVICE

CROSS-REFERENCE TO RELATED APPLICATIONS

The application is based upon and claims the priority of PCT patent application No. PCT/CN2017/114596 filed on Dec. 5, 2017 which claims the priority of Chinese Patent Application No. 201621322923.X filed on Dec. 5, 2016, the entire contents of all of which are hereby incorporated by reference herein for all purposes.

TECHNICAL FIELD

The present disclosure relates to the field of lighting technology, and particularly to a light source apparatus and a lighting device.

BACKGROUND

Lighting lamps in the current market mostly adopt a specialized light source assembly. A lighting lamp adopting a specialized light source assembly usually cannot use a conventional light source assembly. Therefore, if the specialized light source assembly fails or is damaged, it would be faced with the problem that the entire lighting lamp has to be abandoned, which results in an unnecessary waste of lamps.

Moreover, part of existing light source assemblies still involves considerable security risks, and a light source plate and a lamp holder are usually fixed by using a screw fastening manner, which is not convenient for mounting and maintenance and leads to a poor universality upon being applied in a lighting lamp. Therefore, the current market has an urgent need of a light source apparatus with high security, convenient mounting process and good applicability, which can not only meet demands for home usage but also satisfy demands for application in shopping malls and outdoor advertising boxes.

SUMMARY

In view of the problems above, the present disclosure provides a light source apparatus which can overcome the above-mentioned problems or at least partly overcome the above-mentioned problems.

According to one aspect of the present disclosure, a light source apparatus is provided. The light source apparatus includes a light source assembly, a power source assembly electrically connected with the light source assembly, a first end cap, and a second end cap. The light source assembly includes a light source part and a light diffuser, an interior of the light diffuser is formed into a first receiving space which extends along a lengthwise direction of the light diffuser and penetrates the light diffuser, the light source part is mounted in the first receiving space along a lengthwise direction of the light diffuser. The power source assembly includes a power source part and a power source cover, an interior of the power source cover is formed into a second receiving space which extends along a lengthwise direction of the power source cover and penetrates the power source cover, the power source part is mounted in the second receiving space along the lengthwise direction of the light diffuser. One end of the light source assembly is disposed side-by-side and aligned with one end of the power source assembly, the first end cap is sleeved at the end of the light source assembly and the end of the power source assembly which have been disposed side-by-side and aligned with each other. The second end cap includes a fixing ring and a fixing part, the fixing ring is sleeved on the light diffuser along the lengthwise direction of the light diffuser, the fixing part is sleeved at the other end of the power source assembly, so as to fixedly connect the light source assembly and the power source assembly.

According to another aspect of the present disclosure, a lighting device is provided. The lighting device includes: at least two light source apparatuses described in the foregoing, the light source assembly and the power source assembly in the at least two light source apparatuses are disposed in parallel and adjacent to each other. A cable connector assembly configured to electrically connect the at least two light source apparatuses, the cable connector assembly includes a first electric connector, a second electric connector, and a wire disposed between the first electric connector and the second electric connector. The first electric connector and the second electric connector are connected with the power source connector disposed on any two adjacent light source apparatuses, respectively, in a plug-in manner, so as to achieve an electrical connection between the any two adjacent light source apparatuses.

The above examples are merely an outline of technical solutions of the present disclosure. In order to make technical means of the present disclosure more clearly understandable and implementable according to the contents of the description, and in order to make the above-mentioned and other objects, features and advantages of the present disclosure more apparent, concrete embodiments of the present disclosure will be set forth as below.

From the detailed description of the concrete embodiments of the present disclosure in connection with the accompanying drawings as below, the above-mentioned and other objects, advantages and features of the present disclosure will be more apparent for those skilled in the art.

BRIEF DESCRIPTION OF THE DRAWINGS

Various other advantages and benefits will become apparent for those ordinary skilled in the art by reading the following detailed description of preferred embodiments. The accompanying drawings are merely for the purpose of illustrating the preferred embodiments, and are not to be construed as any limitation to the present disclosure. Throughout the accompanying drawings, same reference signs indicate the same components. In the accompanying drawings.

DETAILED DESCRIPTION

Hereinafter, exemplary embodiments of the present disclosure will be described in more details with reference to the accompanying drawings. Although exemplary embodiments of the present disclosure have been illustrated in the accompanying drawings, it should be appreciated that, the present disclosure can be implemented in various ways and should not be limited to the embodiments set forth herein. Instead, these embodiments are provided merely for more thoroughly understanding the present disclosure and enabling the scope of the present disclosure to be completely conveyed to those skilled in the art.

In order to solve the technical problems above, an example of the present disclosure provides a light source apparatus which can be used in a home lighting device, and can also be used in shopping malls and outdoor advertising boxes.

Figure 1:
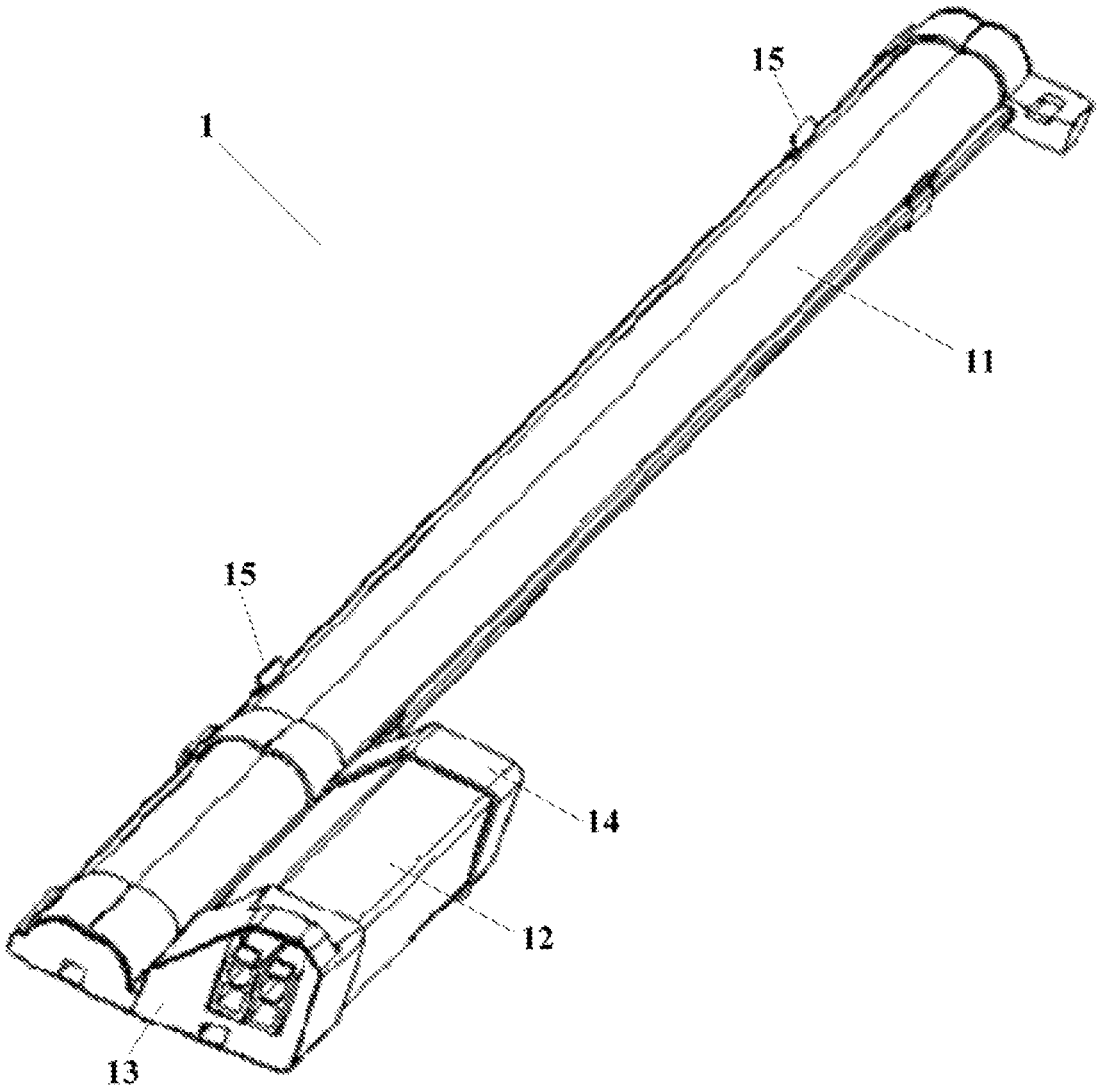
FIG. 1 illustrates a stereo structural diagram of a light source apparatus according to an embodiment of the present disclosure.
Figure 2:
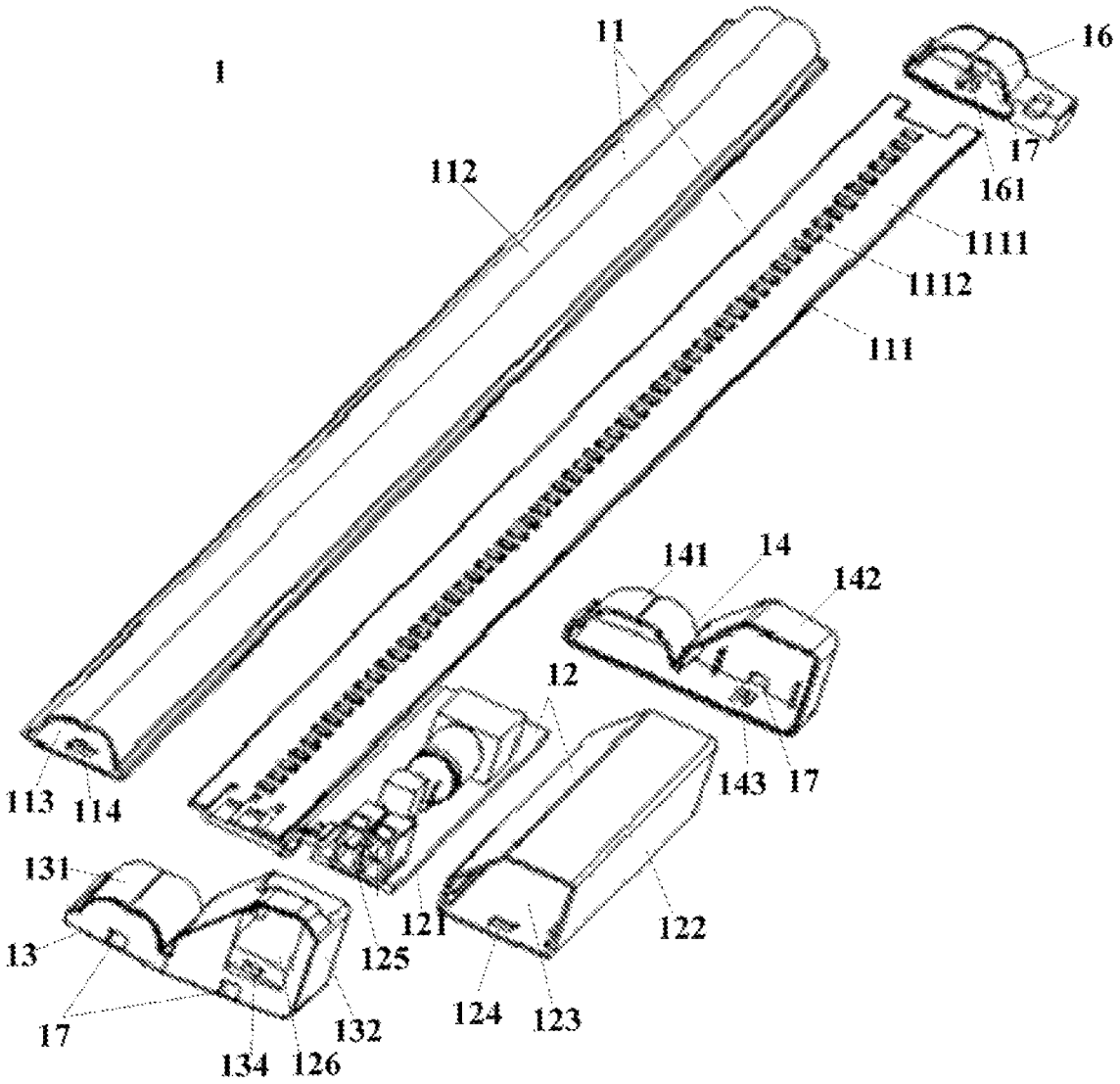
FIG. 2 illustrates a stereo exploded view of a light source apparatus according to an example of the present disclosure.

Referring to FIG. 1 and FIG. 2, a light source apparatus 1 includes a light source assembly 11, a power source assembly 12 electrically connected with the light source assembly 11, a first end cap 13 and a second end cap 14. The light source assembly 11 includes a light source part 111 and a light diffuser 112, an interior of the light diffuser 112 is formed into a first receiving space 113 which extends along a lengthwise direction of the light diffuser 112 and penetrates the light diffuser 112, the light source part 111 is mounted in the first receiving space 113 along a lengthwise direction of the light diffuser 112. The power source assembly 12 includes a power source part 121 and a power source cover 122, an interior of the power source cover 122 is formed into a second receiving space 123 which extends along a lengthwise direction of the power source cover 122 and penetrates the power source cover 122, the power source part 121 is mounted in the second receiving space 123 along the lengthwise direction of the power source cover 122. Both of the light diffuser 112 and the power source cover 122 can be processed by using an extrusion molding technology. By using such technology, the mold can be simplified and the manufacture costs can be reduced.

Figure 3:
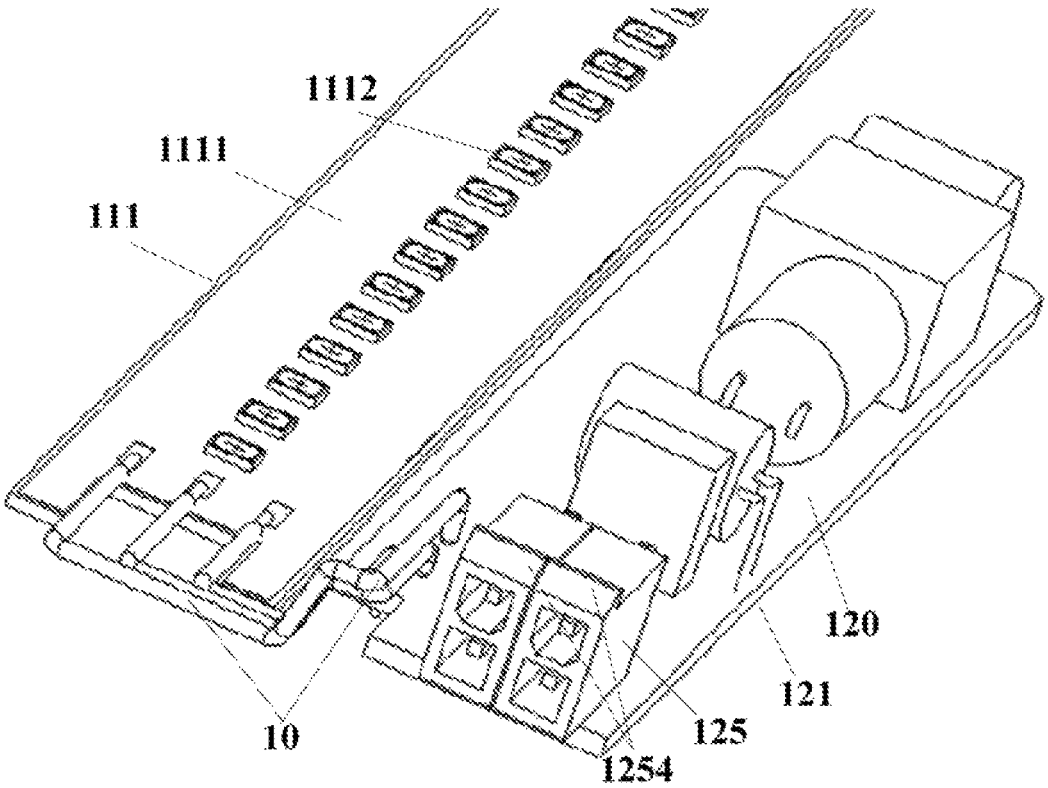
FIG. 3 illustrates a partial stereo structural diagram of a light source apparatus according to an example of the present disclosure.

As illustrated in FIG. 1, FIG. 2 and FIG. 3, the light source assembly 11 and the power source assembly 12 can be electrically connected with each other by using a wire 10 (as illustrated in FIG. 3); the light source part 111 includes a light source plate 1111, the power source part 121 includes a power source plate 120; in a case where one end of the light source assembly 11 is disposed side-by-side and aligned with one end of the power source assembly 12, the light source plate 111 is also disposed side-by-side and aligned with the power source plate 120, and the end of the light source plate 1111 and the end of the power source plate 120 that are disposed side-by-side and aligned with each other are connected to two ends of the wire 10, respectively, so as to achieve an electrical connection between the light source part 111 and the power source part 121, and hence to achieve an electrical connection between the light source assembly 11 and the power source assembly 12. After electrically connecting the light source assembly 11 with the power source assembly 12, the wire 10 can be disposed inside the first end cap 13, so as to ensure the security of electrical connections. In this example, the wire 10 can be welded onto the light source plate 1111 and the power source plate 120, respectively, by way of welding, and can also be connected onto the light source plate 1111 and the power source plate 120 by using other ways.

The first end cap 13 is sleeved at the end of the light source assembly 11 and the end of the power source assembly 12 which have been disposed side-by-side and aligned with each other. The second end cap 14 includes a fixing ring 141 and a fixing part 142; the fixing ring 141 passes through the light diffuser 112 along a lengthwise direction of the light diffuser 112 from the end of the light source assembly 11 which is not disposed side-by-side and aligned with the power source assembly 12, until the fixing part 142 of the second end cover 14 is sleeved at the other end of the power source cover 122, so as to achieve a fixed connection of the light source assembly 11 and the power source assembly 12. Herein, both of the first end cap 13 and the second end cap 14 can be used for fixing the light source assembly 11 and the power source assembly 12; by means of the cooperation between the first end cap and the second end cap, a firm connection of the light source assembly 11 and the power source assembly 12 can be achieved.

In the example of the present disclosure, in a case where the light source assembly 11 and the power source assembly 12 are disposed side-by-side and aligned with each other, the light source part 111 and the power source part 121 achieve a parallel alignment therebetween, and the light diffuser 112 and the power source 122 also achieve a parallel alignment therebetween. Additionally, in this example, the light source assembly 11 can have a strip-shaped structure as illustrated in FIG. 1, and can also have other structures in other shapes such as a square-shaped structure.

Here, the light source assembly and the power source assembly are disposed separately as illustrated in FIG. 1 and FIG. 2, so that upon any one of the two assemblies being damaged, it can be conveniently replaced by a new one, which improves a utilization ratio of resources and a usage rate of the light source apparatus. Moreover, in the case where multiple light source apparatuses are connected in series, if the light source assembly in any of these light source apparatuses involves a problem and cannot work, other light source apparatus(s) connected thereto in series still can work normally without any influence as long as the power source assembly is not damaged.

Figure 4:
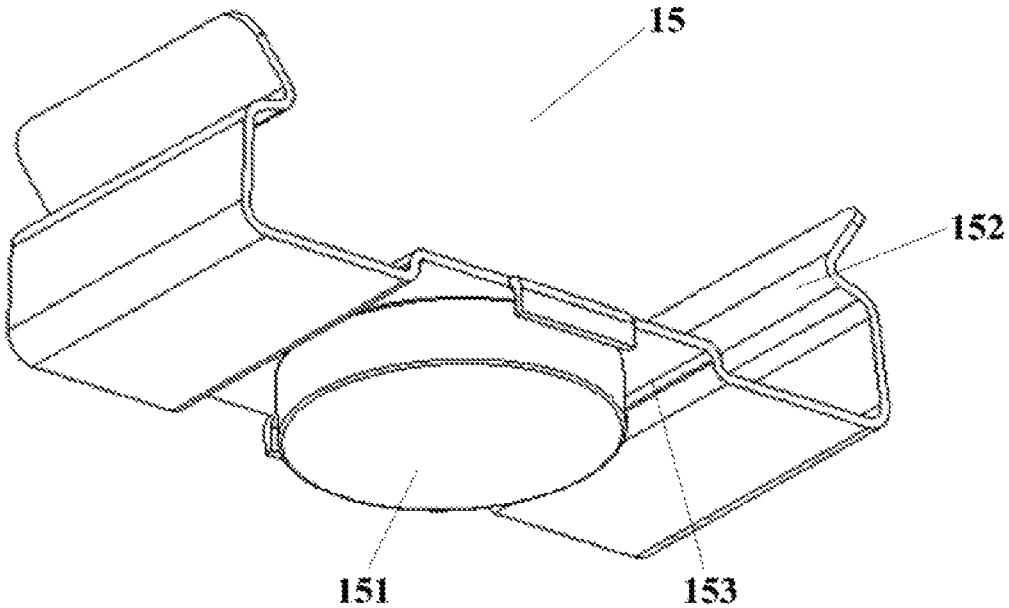
FIG. 4 illustrates a structural diagram of a magnet assembly in a light source apparatus according to an example of the present disclosure.

On the basis of FIG. 1, referring to FIG. 4, in an example of the present disclosure, the light source apparatus 1 further includes a magnet assembly 15. The magnet assembly 15 is fixed on the light source assembly 11, and is provided with a magnet 151 which allows the light source apparatus 1 to be adsorbed onto a base board (not illustrated in FIG. 1 and FIG. 4) of a lighting device. Thus, the light source apparatus 1 can be firmly fixed onto the base board of the lighting device without the need of using a conventional fixing manner such as screw and bolt, which facilitates mounting and disassembling between the light source apparatus 1 and the base board of the lighting device. The magnet 151 and the magnet assembly 15 can be fixed by bonding, screw fastening, welding and the like. Of course, in order to allow the magnet assembly 15 to be adsorbed onto the base board of the lighting device, the base board of the lighting device is required to be made by using a metallic material which can be adsorbed by a magnet, for example, a material such as iron and steel.

In this example, the magnet assembly 15 can have a U-shaped structure. Two sides of the magnet assembly 15 having a U-shaped structure are provided with an elastic clamping element 152, respectively; a left side edge and a right side edge of the light diffuser 112 (illustrated in FIG. 2) along the lengthwise direction of the light diffuser 112 (illustrated in FIG. 2) each are clamped between the elastic clamping element 152 and a bottom side of the magnet assembly 15, so as to fix the magnet assembly 15 onto the light diffuser 112; a middle portion of the bottom side of the magnet assembly 15 having a U-shaped structure is provided with a strip-shaped slot 153, the strip-shaped slot 153 is fixed with a magnet 151. In this example, the magnet 151 has a circular structure; of course, the magnet 151 can also have other structures. The magnet 151 allows the magnet assembly 15 to be adsorbed onto the base board of the lighting device. Moreover, the magnet assembly 15 can also be fixed on the light diffuser 112 by other ways such as gluing, screw fastening and welding, without particularly limited in the examples of the present disclosure.

Figure 5:
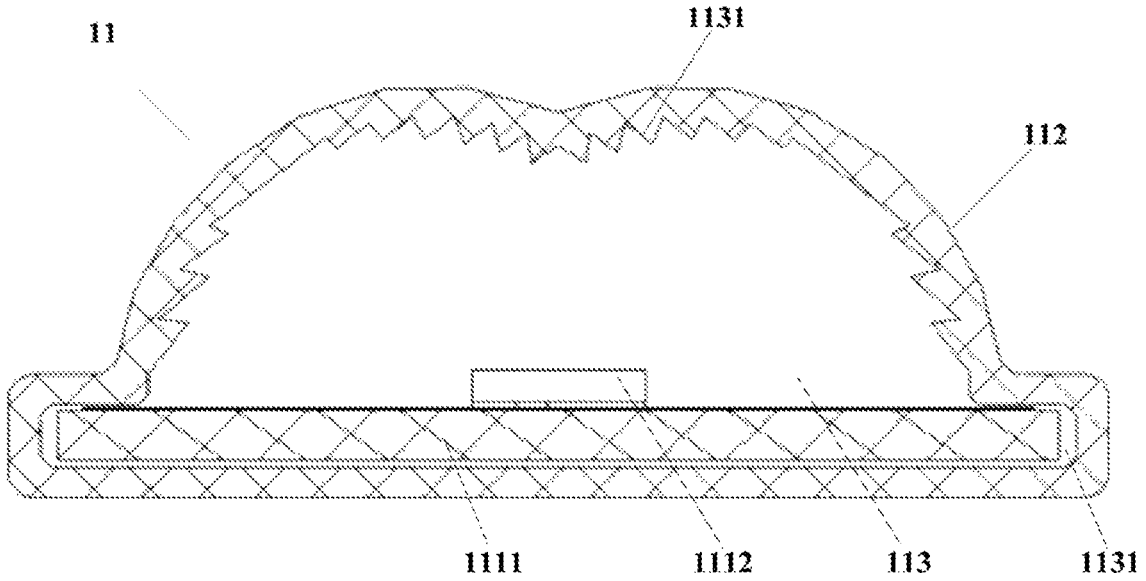
FIG. 5 illustrates a sectional view of a light source assembly in a light source apparatus according to an example of the present disclosure.

Referring to FIG. 5, in an example of the present disclosure, an internal surface of the first receiving space 113 in the light diffuser 112 can be configured as a microstructure 1131 facing the light source part 11. The microstructure 1131 facilitates achieving a uniform light distribution of the light source assembly 11. In this example, the microstructure 1131 can be formed as a plurality of sharp teeth (as illustrated in FIG. 5), and can also be formed as a plurality of arc-shaped, convex ribs. A particular form of the microstructure is not limited in the examples of the present disclosure.

On the basis of FIG. 1 and FIG. 2, referring to FIG. 5, in an example of the present disclosure, the light source part 111 of the light source assembly 11 includes a light source plate 1111 and light-emitting elements 1112; the light source assembly 11 and the power source assembly 12 are electrically connected with each other, and provide an electrical drive for the light-emitting elements 1112. The light-emitting elements 1112 are uniformly arranged on the light source plate 1111 along a length direction of the light source plate 1111. A left side and a right side of the first receiving space 113 along the lengthwise direction of the light diffuser 112 are provided with a groove 1131, respectively; a left side edge and a right side edge of the light source plate 1111 along the lengthwise direction of the light source plate 1111 are disposed in the groove 1131, respectively, so as to fix the light source plate 1111 in the light diffuser 112. An external rim of the groove 1131 can be exactly fixed between the elastic clamping element 152 of the magnet assembly 15 as illustrated in FIG. 4 and the bottom side of the magnet assembly 15, so as to firmly fix the magnet assembly 15 on the light source assembly 11.

In this example, the light source plate 1111 can adopt a PCB board, and can also adopt other circuit boards. The light source plate 1111 can have a rectangular structure, and can also have other structures in other shapes. Using a rectangular-shaped structure facilitates jointing multiple light source plates 1111 together, and is convenient for processing the jointed plates, so as to facilitate improving the utilization ratio of materials for circuit boards and to reduce the manufacture costs. The light-emitting element 1112 can adopt a LED light source, and can also be a light source of other types, for example, an electroluminescent (EL) light source and the like. The shape, the material and the type of the light source of the light source plate 1111 mentioned in the present disclosure are not particularly limited.

Figure 6:
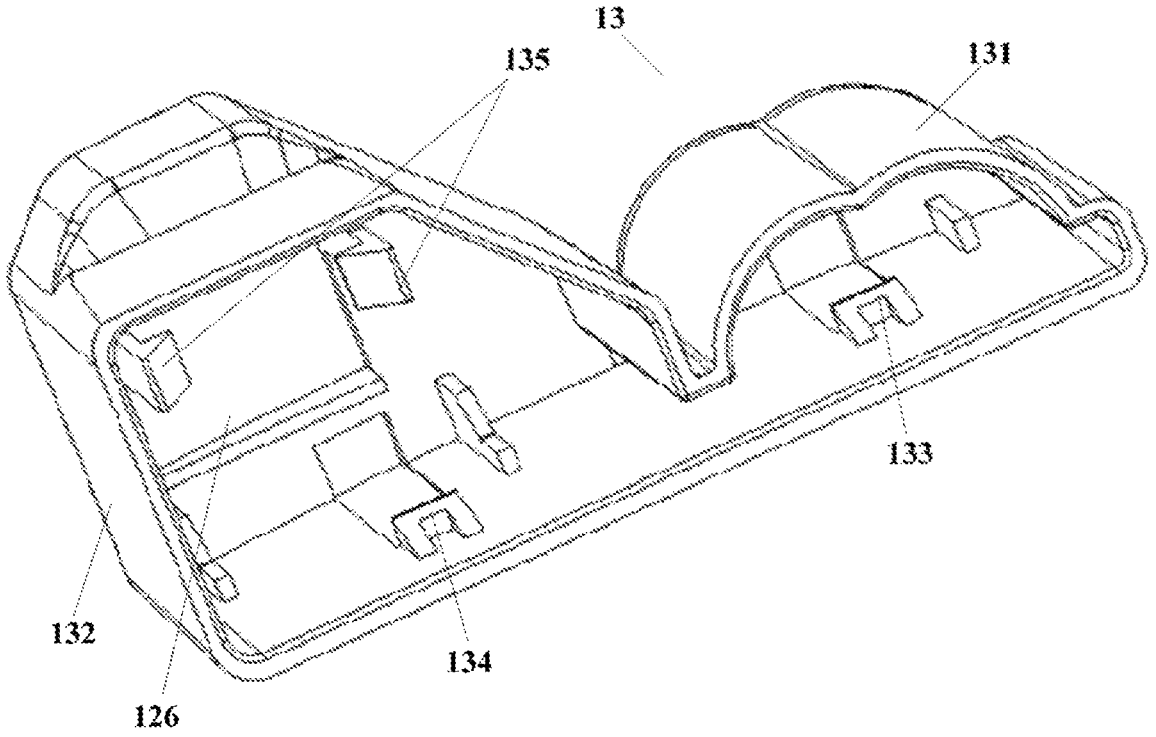
FIG. 6 illustrates a stereo structural diagram of a first end cap in a light source apparatus according to an example of the present disclosure.
Figure 7:
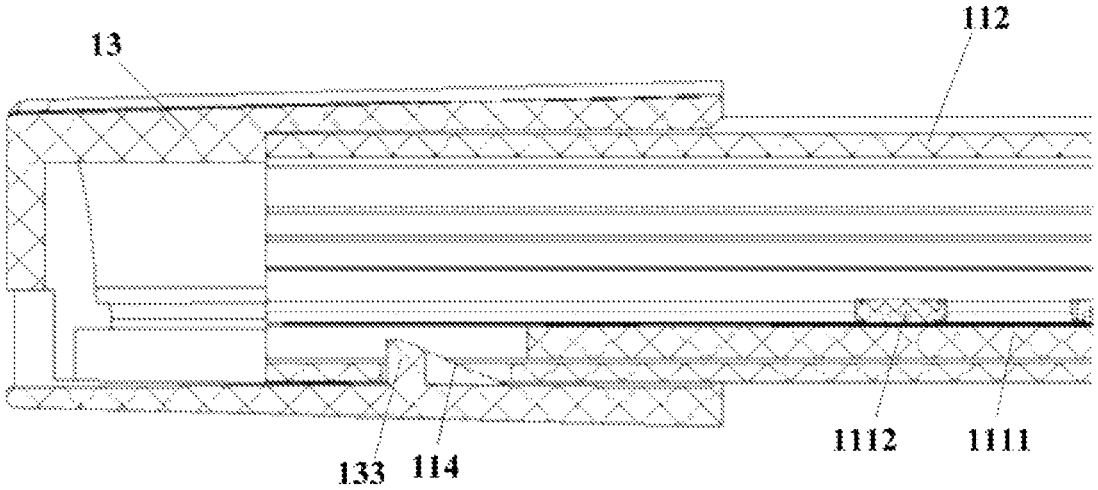
FIG. 7 illustrates a partial sectional view of a light source assembly in a light source apparatus according to an example of the present disclosure.

On the basis of FIG. 2, referring to FIG. 6 and FIG. 7, in an example of the present disclosure, the first end cap 12 includes a light source assembly fixing part 131 and a power source assembly fixing part 132. An interior of the light source assembly fixing part 131 and an interior of the power source assembly fixing part 132 are provided with a first bevel hook 133 and a second bevel hook 134, respectively. In this example, the first bevel hook 133 and the second bevel hook 134 as illustrated in FIG. 2, FIG. 6 and FIG. 7 are located at an internal, bottom side of the light source assembly fixing part 131 and the power source assembly fixing part 132, respectively. The first bevel hook 133 and the second bevel hook 134 can also be located at other positions of the light source assembly fixing part 131 and the power source assembly fixing part 132, respectively, which are not particularly limited in the examples of the present disclosure. The light diffuser 112 is disposed side-by-side and aligned with the power source cover 122; one end of the light diffuser 112 and one end of the power source cover 122 that are disposed side-by-side and aligned with each other are provided with a first through hole 114 corresponding to the first bevel hook 133 and a second through hole 124 corresponding to the second bevel hook 134, respectively. By allowing the first bevel hook 133 to be hooked in the first through hole 114, and by allowing the second bevel hook 134 to be hooked in the second through hole 124, the light diffuser 112 and the power source cover 122 can be fixed on the first end cap 13, respective. By means of the cooperation between the bevel hook and the through hole, it not only makes the connection between the first end cap 13 and each of the light diffuser 112 and the power source cover 122 more convenient, but also makes an assembling process of the first end cap 13 easier. At the same time, it also can prevent the wire 10 (as illustrated in FIG. 3) connecting the light source assembly 11 with the power source assembly 12 from being exposed to the outside, so as to effectively improve the safety of the light source assembly 11.

On the basis of FIG. 2, referring to FIG. 6 and FIG. 7, in an example of the present disclosure, a position of the first bevel hook 133 and a position of the second bevel hook 134 can be exchanged with a position of the corresponding first through hole 114 and a position of the corresponding second through hole 124, respectively; that is, the first bevel hook 133 and the second bevel hook 134 can be disposed on the light diffuser 112 and the poser source cover 122, respectively, and the first through hole 114 and the second through hole 124 can be disposed in the interior of the light source assembly fixing part 131 and the interior of the power source assembly fixing part 132, respectively; in such case, similarly, by means of the cooperation between the bevel hook and the through hole, it also can achieve fixing the light diffuser 112 and the power source 122 with the first end cap 13, respectively. This is not particularly limited in the examples of the present disclosure.

In this example, in order to firmly fix the first end cap 13 on the light source assembly 11 and the power source assembly 12, the light source assembly fixing part 131 of the first end cap 13 can be configured to have a shape and a structure as same as that of the light diffuser 112, and an opening of the light source assembly fixing part 131 can be made slightly larger than an opening of the light diffuser 112. At the same time, the power source assembly fixing part 132 can be configured to have a shape and a structure as same as that of the power source cover 122, and an opening of the power source assembly fixing part 132 can be made slightly larger than an opening of the power source cover 122.

Still referring to FIG. 2, in an example of the present disclosure, an interior of the fixing part 142 of the second end cap 14 is provided with a third bevel hook 143, and the end of the power source cover 122 that is not disposed side-by-side and aligned with the light diffuser 112 is provided with a third through hole (not illustrated) corresponding to the third bevel hook 143, the third bevel hook 143 is hooked in the third through hole so as to fix the second end cap 14 on the power source cover 122. In this example, the third bevel hook 143 illustrated in FIG. 2 can be located at an internal, bottom side of the fixing part 142 of the second end cap 14. The third bevel hook 143 can also be disposed at other positions of the fixing part 142, which is not particularly limited in the present example. Additionally, a position of the third bevel hook 143 and a position of the third through hole can be exchanged with each other, that is, the third bevel hook 143 can be disposed on the power source cover 122, and the third through hole can be disposed at a position on the fixing part 142 of the second end cap 14 corresponding to the third bevel hook 143. In such case, similarly, by means of the cooperation between the bevel hook and the through hole, it also can achieve fixing the second end cap 143 with the power source cover 122, which is not particularly limited in the examples of the present disclosure.

In this example, in order to firmly fix the second end cap 14 on the light source assembly 11 and the power source assembly 12, the fixing ring 141 of the second end cap 14 can be configured to have a shape and a structure as same as that of the light diffuser 112, and an opening of the fixing ring 141 can be made slightly larger than an opening of the light diffuser 112. At the same time, the fixing part 142 of the second end cap 14 can be configured to have a shape and a structure as same as that of the power source cover 122, and an opening of the fixing part 142 can be made slightly larger than an opening of the power source cover 122. The particular shape and structure of light diffuser 112 and the power source cover 122 are not limited in the examples of the present disclosure.

Still referring to FIG. 2, in an example of the present disclosure, the light source apparatus 1 can further include a third end cap 16. The third end cap 16 is sleeved at the end of the light diffuser 112 which is not disposed side-by-side and aligned with the power source cover 122. An interior of the third end cap 16 is provided with a fourth bevel hook 161, and the end of the light diffuser 112 that is not disposed side-by-side and aligned with the power source cover 122 is provided with a fourth through hole (not illustrated in FIG. 2) corresponding to the fourth bevel hook 161, the fourth bevel hook 161 is hooked in the fourth through hole so as to fix the third end cap 16 on the light diffuser 112.

In this example, the fourth bevel hook 161 illustrated in FIG. 2 is located at an internal, bottom side of the third end cap 16, but it can also be disposed at other positions of the third end cap 16, which is not particularly limited in the present example. Additionally, a position of the fourth bevel hook 161 and a position of the fourth through hole can be exchanged with each other, that is, the fourth bevel hook 161 can be disposed on the light diffuser 112, and the fourth through hole can be disposed at a position in the interior of the third end cap 16 corresponding to the fourth bevel hook 161. In such case, similarly, by means of the cooperation between the bevel hook and the through hole, it also can achieve fixing the third end cap 16 with the light diffuser 112, which is not particularly limited in the examples of the present disclosure.

In this example, in order to firmly fix the third end cap 16 on the light source assembly 11, the third end cap 16 can be configured to have a shape and a structure as same as that of the light diffuser 112, and an opening of the third end cap 16 can be made slightly larger than an opening of the light diffuser 112. The particular shape and structure of light diffuser 112 and the power source cover 122 are not limited in the examples of the present disclosure.

By means of the cooperation between the bevel hook and the through hole, it not only makes the connection between the second end cap 14 and each of the light diffuser 112 and the power source cover 122 as well as the connection between the third end cap 16 and the light diffuser 112 more convenient, but also makes an assembling process of the second end cap 14 and the third end cap 16 simpler, which further allows for more convenient and efficient mounting and disassembling process of the light source apparatus 1.

Referring to FIG. 2, in an example of the present disclosure, each of the first end cap 13, the second end cap 14 and the third end cap 13 is provided with at least one eyelet 17, the eyelet 17 facilitates opening the mold during production and processing of the first end cap 13, the second end cap 14 and the third end cap 16.

Figure 8:
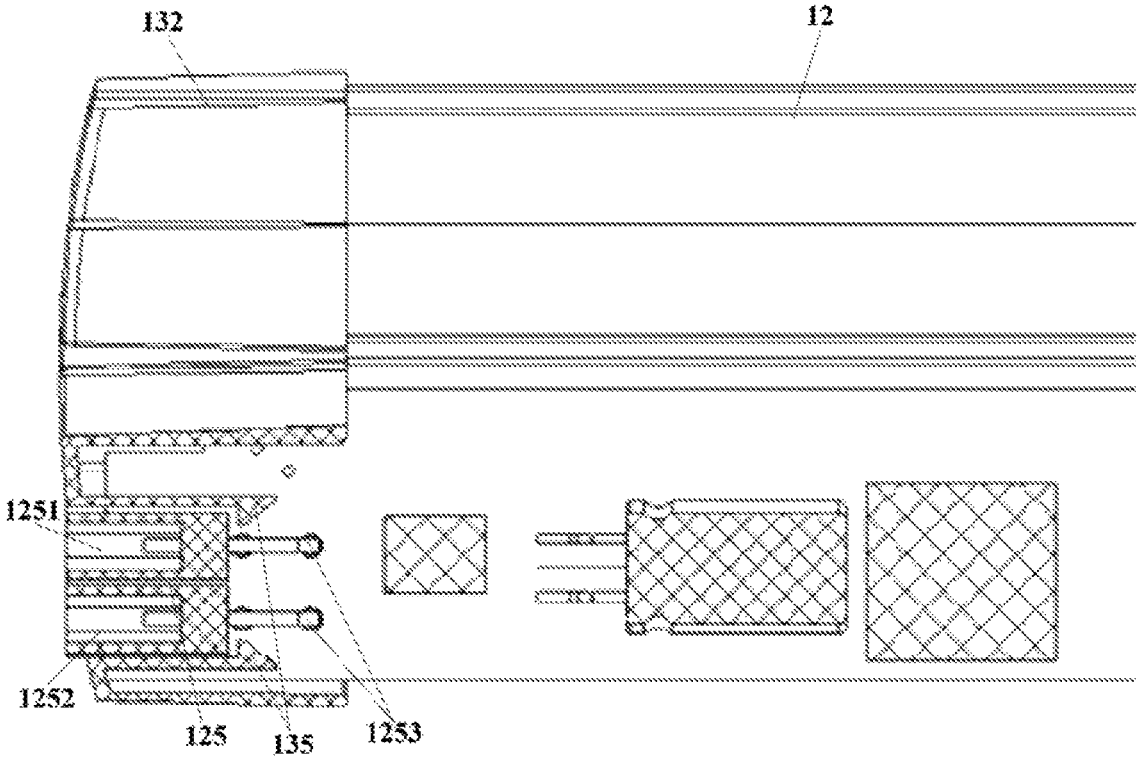
FIG. 8 illustrates a partial sectional view of a power source assembly in a light source apparatus according to an example of the present disclosure.

On the basis of FIG. 2 and FIG. 6, referring to FIG. 8, in an example of the present disclosure, an interior of the power source assembly fixing part 132 of the first end cap 13 is provided with a pair of one-way hooks 135, the power source part 121 is provided with a power source connector 125 configured to be connected to an external power supply (not illustrated in any of FIG. 2, FIG. 6 and FIG. 8), and the one-way hook 135 is located on an end cap face on the power source assembly fixing part 132 which is opposite to the power source connector 125. Furthermore, the one-way hook 135 is exactly hooked at an edge of the power source connector 125 so as to firmly fix the first end cap 13 onto the power source part 121 (as illustrated in FIG. 2).

Still referring to FIG. 6 and FIG. 8, in an example of the present disclosure, the power source connector 125 includes an input terminal 1251 and an output terminal 1252, the input terminal 1251 and the output terminal 1252 are provided with a conductive terminal pin 1253 (as illustrated in FIG. 8), respectively, the conductive terminal pin 1253 is electrically connected with the power source plate 120 (as illustrated in FIG. 3) and configured to connect the power source connector 125 to an external power supply so that the power source assembly 12 is connected to the external power supply. Particular positions of the input terminal 1251 and the output terminal 1252 are not limited in the present disclosure, a position of the input terminal 1251 can be provided with an output terminal, and a position of the output terminal 1252 can be provided with an input terminal.

In order to facilitate the connection between the power source assembly 12 and the external power supply, the power source assembly fixing part 132 of the first end part 13 can be provided with an opening 126, the opening 126 can be disposed at a position opposite to the power supply connector 125, the input terminal 1251 and the output terminal 1252 pass through the opening 126 so as to achieve the connection to the external power supply. In this example, the opening 126 is a square opening. In practical applications, the opening 126 can be an opening with other shapes such as circle and oval, without limited in the present disclosure.

Figure 9:
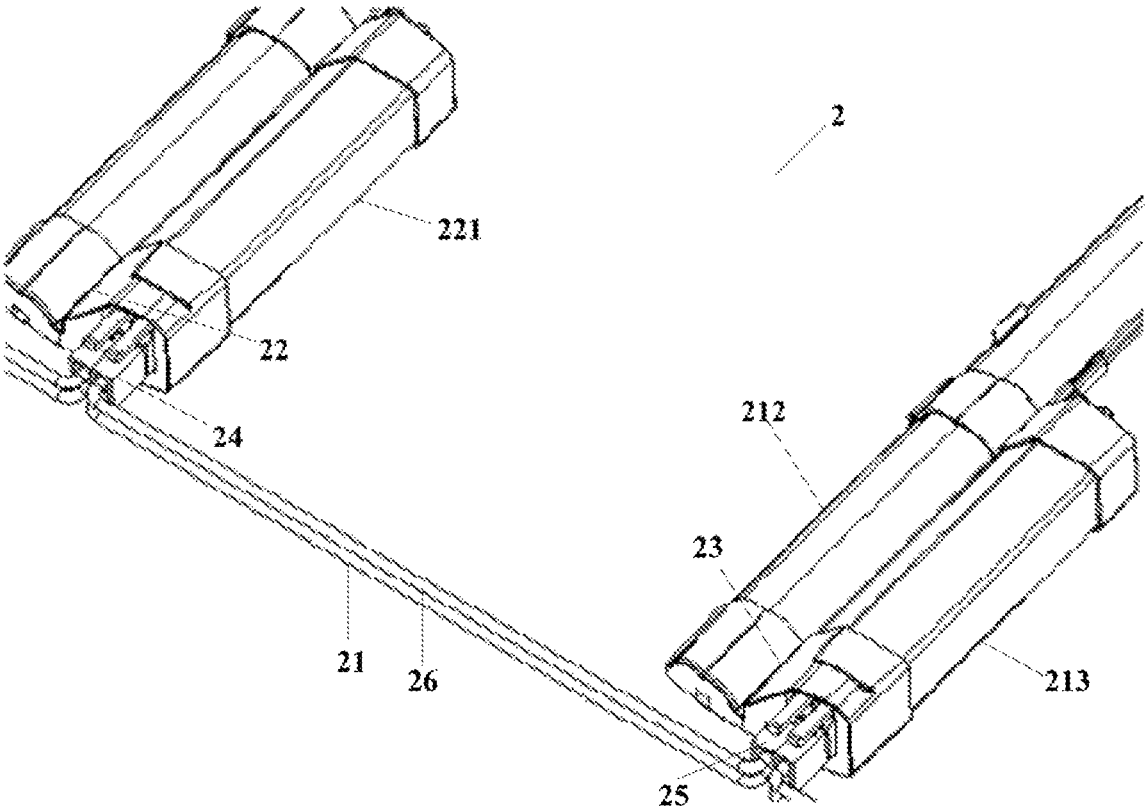
FIG. 9 illustrates a partial structural diagram of a lighting device according to an example of the present disclosure.

Referring to FIG. 8 and FIG. 9, an example of the present disclosure further provides a lighting device 2, including a cable connector assembly 21 and at least two light source apparatuses described in the foregoing examples. The light source assembly and the power source assembly in the at least two light source apparatuses are disposed in parallel and adjacent to each other. The cable connector assembly 21 is configured to electrically connect the at least two light source apparatuses, and the cable connector assembly 21 includes a first electric connector 24, a second electric connector 25, and a wire 26 disposed between the first electric connector 24 and the second electric connector 25. The first electric connector 24 and the second electric connector 25 are configured to be connected with the power source connectors 125 disposed on the power source assemblies in any two adjacent light source apparatuses, respectively, in a plug-in manner, so as to achieve an electrical connection between the any two adjacent light source apparatuses.

Still referring to FIG. 9, in this example, a lighting device 2 includes two light source apparatuses which are a light source apparatus 22 and a light source apparatus 23, respectively. The power source assembly 221 of the light source apparatus 22 and the light source assembly 212 of the light source apparatus 23 are disposed in parallel and adjacent to each other. The first electric connector 24 of the cable connector assembly 21 is connected with the power source connector (not illustrated in FIG. 9) of the power source assembly 221 of the light source apparatus 22 in a plug-in manner, and the second electric connector 25 is connected with the power source connector (not illustrated in FIG. 9) of the power source assembly 213 of the light source apparatus 23 in a plug-in manner, so as to achieve the electrical connection between the power source assembly 221 and the power source assembly 213, and hence to achieve the electrical connection between the light source apparatus 22 and the light source apparatus 23.

Figure 10:
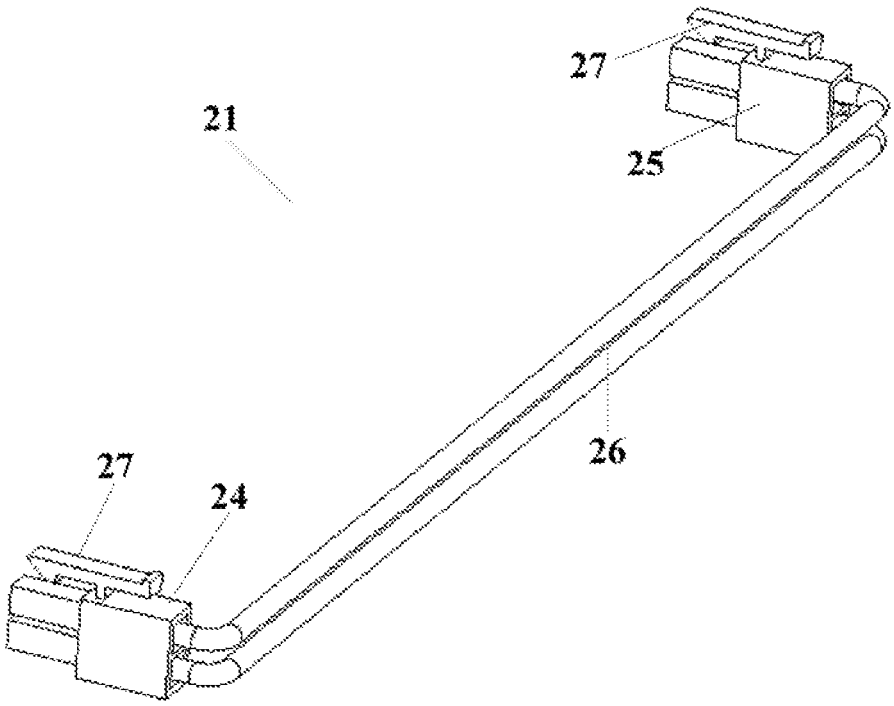
FIG. 10 illustrates a structural diagram of a cable connector assembly in a lighting device according to an example of the present disclosure.

Referring to FIG. 3 and FIG. 10, in an example of the present disclosure, the first electric connector 24 and the second electric connector 25 are provided with a buckle element 27, respectively, and the power source connector 125 is provided with a buckle receiver part 1254 (as illustrated in FIG. 3) corresponding to the buckle element 27. The buckle element 27 is buckled at the buckle receiver part 1254, so as to achieve the fixed connection between the power source connector 125 and each of the first electric connector 24 and the second electric connector 25.

Referring to FIG. 8, in an example of the present disclosure, the power source connector 125 of the power source assembly 12 includes an input terminal 1251 and an output terminal 1252. Referring to FIG. 9, the first electric connector 24 and the second electric connector 25 are connected with the input terminal (not illustrated in FIG. 9) of the power source assembly 221 of one light source apparatus 22 in any two adjacent light source apparatuses 22, 23 and the output terminal (not illustrated in FIG. 9) of the power source assembly 213 of the other light source apparatus 23 in the any two adjacent light source apparatuses 22, 23, respectively, in a plug-in manner, so as to achieve the electrical connection between the light source apparatus 22 and the light source apparatus 23.

FIG. 9 illustrates a schematic diagram in which two light source apparatuses are connected in series. Of course, according to actual demands, the number of the light source apparatuses as connected can be increased so as to achieve a serial connection of multiple light source apparatuses, for example, three light source apparatuses connected in series, four light source apparatuses connected in series, and the like. In this example, it's possible that the first electric connector is connected to the input terminal of one light source apparatus while the second electric connector is connected to the output terminal of the other light source apparatus; and it's also possible that the first electric connector is connected to the output terminal of one light source apparatus while the second electric connector is connected to the input terminal of the other light source apparatus, which is not particularly limited in the examples of the present disclosure.

Optionally, the light source apparatus further includes a magnet assembly, the magnet assembly is fixed at the light source assembly, the magnet assembly is provided with a magnet, and the magnet is configured to allow the light source apparatus to be adsorbed onto a base board of a lighting device.

Optionally, the magnet assembly has a U-shaped structure, both sides of the magnet assembly having the U-shaped structure are respectively provided with an elastic clamping element, a left side edge and a right side edge of the light diffuser along the lengthwise direction of the light diffuser each are clamped between the elastic clamping element and a bottom side of the magnet assembly, so that the magnet assembly is fixed on the light diffuser.

Optionally, an internal surface of the first receiving space is provided with a microstructure configured for light distribution, the microstructure faces the light source part.

Optionally, the microstructure includes a plurality of sharp teeth or a plurality of arc-shaped, convex ribs.

Optionally, the light source part includes a light source plate and a light-emitting element; a left side and a right side of the first receiving space along the lengthwise direction of the light diffuser are respectively provided with a groove, and a left side edge and a right side edge of the light source plate along a lengthwise direction of the light source plate are disposed in the groove respectively, so as to fix the light source plate in the light diffuser.

Optionally, the first end cap includes a light source assembly fixing part and a power source assembly fixing part; an interior of the light source assembly fixing part and an interior of the power source assembly fixing part are provided with a first bevel hook and a second bevel hook, respectively; the light diffuser is disposed side-by-side and aligned with the power source cover, one end of the light diffuser and one end of the power source cover that are disposed side-by-side and aligned with each other are provided with a first through hole corresponding to the first bevel hook and a second through hole corresponding to the second bevel hook, respectively; the first bevel hook is hooked in the first through hole, the second bevel hook is hooked in the second through hole, so that the light diffuser and the power source cover are fixed on the first end cap, respectively.

Optionally, the interior of the power source assembly fixing part of the first end cap is provided with a pair of one-way hooks, the power source part is provided with a power source connector configured to be connected to an external power source, the one-way hook is located on an end cap face of the power source assembly fixing part opposite to the power source connector;

the first end cap is sleeved at the end of the light diffuser and the end of the power source cover which have been disposed side-by-side and aligned with each other, and the one-way hook is hooked at the power source connector, so that the first end cap is fixed on the power source part.

Optionally, a position on the power source assembly fixing part of the first end cap that is opposite to the power source connector is provided with an opening; the power source connector includes an input terminal and an output terminal, the input terminal and the output terminal pass through the opening to be connected to an external power supply.

Optionally, the input terminal is further configured to be connected to an output terminal of one adjacent light source apparatus, and the output terminal is further configured to be connected to an input terminal of another adjacent light source apparatus, so as to achieve an electrical connection between at least two light source apparatuses.

Optionally, an interior of the second end cap is provided with a third bevel hook; one end of the power source cover that is not disposed side-by-side and aligned with the light diffuser is provided with a third through hole corresponding to the third bevel hook; the third bevel hook is hooked in the third through hole, so that the second end cap is fixed on the power source cover.

Optionally, the light source apparatus further includes: a third end cap, the third end cap is sleeved at one end of the light diffuser which is not disposed side-by-side and aligned with the power source cover.

Optionally, an interior of the third end cap is provided with a fourth bevel hook; the end of the light diffuser that is not disposed side-by-side and aligned with the power source cover is provided with a fourth through hole corresponding to the fourth bevel hook; the fourth bevel hook is hooked in the fourth through hole, so that the third end cap is fixed on the light diffuser.

Optionally, the power source connector of the light source apparatus includes an input terminal and an output terminal; the first electric connector and the second electric connector are connected with an input terminal of one light source apparatus in any two adjacent light source apparatuses and an output terminal of the other light source apparatus in the any two adjacent light source apparatuses, respectively, in a plug-in manner, so as to achieve the electrical connection between the any two adjacent light source apparatuses.

Optionally, the first electric connector and the second electric connector are provided with a buckle element, respectively; the power source connector is provided with a buckle receiver part corresponding to the buckle element; the buckle element is buckled at the buckle receiver part to achieve a fixed connection between the first electric connector and the power source connector, and a fixed connection between the second electric connector and the power source connector, respectively.

In the examples of the present disclosure, a fixed mounting between the light source assembly and the power source assembly is achieved by smartly designing the structures of the first end cap and the second end cap; moreover, the light source part and the light diffuser in the light source assembly, as well as the power source part and power source cover in the power source assembly can be easily connected for convenient mounting and disassembling process. Additionally, the light source part of the light source apparatus has no need of adopting a specialized light source part, but can be any light source part which can be mounted in the light diffuser and can achieve an appropriate fixing; upon the light source part being damaged, it's also convenient to be replaced by a new light source part so as to keep using the light source apparatus, thereby improving a usage ratio of resources.

Furthermore, the design for various components is easy, which not only allows for convenient mounting of the entire light source apparatus, but also simplifies the molds used for processing the components, so as to effectively reduce the processing costs.

So far, those skilled in the art should be appreciated that, although several exemplary embodiments of the present disclosure have been particularly illustrated and described, various other modifications or changes in accordance with the principle of the present disclosure may be directly determined or derived, within the spirit and principle of the present disclosure, based on the contents disclosed in the preset invention. Therefore, the scope of the present disclosure should be interpreted and confirmed as covering all these other modifications and changes.

What is claimed is:

1. A light source apparatus, comprising: a light source assembly, a power source assembly electrically connected with the light source assembly, a first end, and a second end, the light source assembly comprising a light source part and a light diffuser, an interior of the light diffuser comprising a first receiving space, the first receiving space extending along a lengthwise direction of the light diffuser and penetrating the light diffuser, the light source part being mounted in the first receiving space along the lengthwise direction of the light diffuser;

the power source assembly comprising a power source part and a power source cover, an interior of the power source cover comprising a second receiving space, the second receiving space extending along a lengthwise direction of the power source cover and penetrating the power source cover, the power source part being mounted in the second receiving space along the lengthwise direction of the power source cover;

one end of the light source assembly being disposed side-by-side and aligned with one end of the power source assembly, the first end being sleeved at the end of the light source assembly and the end of the power source assembly having been disposed side-by-side and aligned with each other;

the second end comprising a fixing ring and a fixing part, the fixing ring being sleeved on the light diffuser along the lengthwise direction of the light diffuser, the fixing part being sleeved at the other end of the power source assembly so as to fixedly connect the light source assembly and the power source assembly; and the second end being fixed at one end of the power source cover, wherein the second end surrounds at least a portion of the light diffuser, and the second end is disposed opposite to the first end; and wherein the light source assembly and the power source assembly have different lengths and the light source assembly is longer than the power source assembly.

2. The light source apparatus according to claim 1, wherein the light source apparatus further comprises a magnet assembly, the magnet assembly is fixed at the light source assembly, the magnet assembly is provided with a magnet, and the magnet is configured to allow the light source apparatus to be adsorbed onto a base board of a lighting device.

3. The light source apparatus according to claim 2, wherein the magnet assembly has a U-shaped structure, both sides of the magnet assembly having the U-shaped structure are provided with an elastic clamping element respectively, a left side edge and a right side edge of the light diffuser along the lengthwise direction of the light diffuser each are clamped between the elastic clamping element and a bottom side of the magnet assembly, so that the magnet assembly is fixed on the light diffuser.

4. The light source apparatus according to claim 1, wherein an internal surface of the first receiving space is provided with a microstructure configured for light distribution, the microstructure faces the light source part.

5. The light source apparatus according to claim 4, wherein the microstructure comprises a plurality of sharp teeth or a plurality of arc-shaped, convex ribs.

6. The light source apparatus according to claim 1, wherein the light source part comprises a light source plate and a light-emitting element;

a left side and a right side of the first receiving space along the lengthwise direction of the light diffuser are respectively provided with a groove, and a left side edge and a right side edge of the light source plate along a lengthwise direction of the light source plate are disposed in the groove respectively, so as to fix the light source plate in the light diffuser.

7. The light source apparatus according to claim 1, wherein the first end comprises a light source assembly fixing part and a power source assembly fixing part;

an interior of the light source assembly fixing part and the interior of the power source assembly fixing part are provided with a first bevel hook and a second bevel hook, respectively;

the light diffuser is disposed side-by-side and aligned with the power source cover, one end of the light diffuser and one end of the power source cover that are disposed side-by-side and aligned with each other are provided with a first through hole corresponding to the first bevel hook and a second through hole corresponding to the second bevel hook, respectively;

the first bevel hook is hooked in the first through hole, the second bevel hook is hooked in the second through hole, so that the light diffuser and the power source cover are fixed on the first end, respectively.

8. The light source apparatus according to claim 7, wherein the interior of the power source assembly fixing part of the first end is provided with a pair of one-way hooks, the power source part is provided with a power source connector configured to be connected to an external power source, the one-way hook is located on an end face of the power source assembly fixing part opposite to the power source connector;

the first end is sleeved at the end of the light diffuser and the end of the power source cover which have been disposed side-by-side and aligned with each other, and the one-way hook is hooked at the power source connector, so that the first end is fixed on the power source part.

9. The light source apparatus according to claim 8, wherein a position on the power source assembly fixing part of the first end that is opposite to the power source connector is provided with an opening;

the power source connector comprises an input terminal and an output terminal, the input terminal and the output terminal pass through the opening to be connected to an external power supply.

10. The light source apparatus according to claim 9, wherein the input terminal is further configured to be connected to an output terminal of one adjacent light source apparatus, and the output terminal is further configured to be connected to an input terminal of another adjacent light source apparatus, so as to achieve an electrical connection between at least two light source apparatuses.

11. The light source apparatus according to claim 1, wherein an interior of the second end is provided with a third bevel hook;

the end of the power source cover that is not disposed side-by-side and aligned with the light diffuser is provided with a third through hole corresponding to the third bevel hook;

the third bevel hook is hooked in the third through hole, so that the second end is fixed on the power source cover.

12. The light source apparatus according to claim 1, wherein the light source apparatus further comprises: a third end, the third end is sleeved at one end of the light diffuser which is not disposed side-by-side and aligned with the power source cover.

13. The light source apparatus according to claim 12, wherein an interior of the third end is provided with a fourth bevel hook;

the end of the light diffuser that is not disposed side-by-side and aligned with the power source cover is provided with a fourth through hole corresponding to the fourth bevel hook;

the fourth bevel hook is hooked in the fourth through hole, so that the third end is fixed on the light diffuser.

14. A lighting device, comprising:

at least two light source apparatuses, each light source apparatus comprising: a light source assembly, a power source assembly electrically connected with the light source assembly, a first end, and a second end, the light source assembly comprising a light source part and a light diffuser, an interior of the light diffuser comprising a first receiving space, the first receiving space extending along a lengthwise direction of the light diffuser and penetrating the light diffuser, the light source part being mounted in the first receiving space along the lengthwise direction of the light diffuser;

the power source assembly comprising a power source part and a power source cover, an interior of the power source cover comprising a second receiving space, the second receiving space extending along a lengthwise direction of the power source cover and penetrating the power source cover, the power source part being mounted in the second receiving space along the lengthwise direction of the power source cover;

one end of the light source assembly being disposed side-by-side and aligned with one end of the power source assembly, the first end being sleeved at the end of the light source assembly and the end of the power source assembly having been disposed side-by-side and aligned with each other;

the second end comprising a fixing ring and a fixing part, the fixing ring being sleeved on the light diffuser along the lengthwise direction of the light diffuser, the fixing part being sleeved at the other end of the power source assembly so as to fixedly connect the light source assembly and the power source assembly, wherein the light source assembly and the power source assembly in the at least two light source apparatuses are disposed in parallel and adjacent to each other;

the second end being fixed at one end of the power source cover, wherein the second end surrounds at least a portion of the light diffuser, and the second end is disposed opposite to the first end; and a cable connector assembly, configured to electrically connect the at least two light source apparatuses, the cable connector assembly comprising a first electric connector, a second electric connector, and a wire disposed between the first electric connector and the second electric connector;

wherein the power source part comprises a power source connector configured to be connected to an external power supply, the first electric connector and the second electric connector are respectively connected with the power source connector disposed on two adjacent light source apparatuses in a plug-in manner, so as to achieve an electrical connection between the two adjacent light source apparatuses; and wherein the light source assembly and the power source assembly have different lengths and the light source assembly is longer than the power source assembly.

15. The lighting device according to claim 14, wherein the power source connector of the light source apparatus comprises an input terminal and an output terminal;

the first electric connector and the second electric connector of the cable connector assembly are connected with an input terminal of one light source apparatus in the two adjacent light source apparatuses and an output terminal of the other light source apparatus in the two adjacent light source apparatuses, respectively, in a plug-in manner, so as to achieve the electrical connection between the two adjacent light source apparatuses.

16. The lighting device according to claim 14, wherein the first electric connector and the second electric connector are provided with a buckle element, respectively;

the power source connector is provided with a buckle receiver part corresponding to the buckle element;

the buckle element is buckled at the buckle receiver part to achieve a fixed connection between the first electric connector and the power source connector, and a fixed connection between the second electric connector and the power source connector, respectively.

17. A light source apparatus, comprising:

a light source assembly comprising a light source part and a light diffuser, an interior of the light diffuser comprising a first receiving space, the first receiving space extending along a lengthwise direction of the light diffuser and penetrating the light diffuser, the light source part being mounted in the first receiving space along the lengthwise direction of the light diffuser;

a power source assembly electrically connected with the light source assembly, the power source assembly comprising a power source part and a power source cover, an interior of the power source cover comprising a second receiving space, the second receiving space extending along a lengthwise direction of the power source cover and penetrating the power source cover, the power source part being mounted in the second receiving space along the lengthwise direction of the power source cover;

one end of the light source assembly being disposed side-by-side and aligned with one end of the power source assembly, a first end being sleeved at the end of the light source assembly and the end of the power source assembly having been disposed side-by-side and aligned with each other; and a second end being fixed at one end of the power source cover, wherein the second end surrounds at least a portion of the light diffuser, and the second end is disposed opposite to the first end;

wherein the light source assembly and the power source assembly have different lengths and the light source assembly is longer than the power source assembly.

18. The light source apparatus according to claim 17, an interior of the second end is provided with a third bevel hook;

the end of the power source cover that is disposed opposite to the first end is provided with a third through hole corresponding to the third bevel hook;

the third bevel hook is hooked in the third through hole, so that the second end is fixed on the power source cover.

19. The light source apparatus according to claim 18, wherein the second end comprises a fixing ring and a fixing part, wherein the fixing ring is sleeved on the light diffuser along the lengthwise direction of the light diffuser, the fixing part is sleeved at the other end of the power source assembly so as to fixedly connect the light source assembly and the power source assembly.

20. The light source apparatus according to claim 19, wherein the light source apparatus further comprises a magnet assembly, the magnet assembly is fixed at the light source assembly, the magnet assembly is provided with a magnet, and the magnet is configured to allow the light source apparatus to be adsorbed onto a base board of a lighting device.

* * * * *